United States Patent [19]

Mayer

[11] 4,056,352

[45] Nov. 1, 1977

[54] DRY TRANSFER OF ORGANIC COMPOUNDS TO WEBS

[75] Inventor: Fritz Mayer, Haltingen, Germany

[73] Assignee: Ciba-Geigy AG, Haltingen, Germany

[21] Appl. No.: 704,898

[22] Filed: July 13, 1976

Related U.S. Application Data

[63] Continuation of Ser. No. 497,599, Aug. 15, 1974, abandoned.

[30] Foreign Application Priority Data

Aug. 22, 1973 Switzerland ..... 12062/73

[51] Int. Cl.[2] ..... D06P 1/00

[52] U.S. Cl. ..... 8/2.5 A; 68/5 D; 101/470

[58] Field of Search ..... 8/2.5 A; 68/5 C, 5 D; 101/467, 470, 471

[56] References Cited

U.S. PATENT DOCUMENTS

| | | | |
|---|---|---|---|
| 690,746 | 1/1902 | Lundeberg | 118/50 |
| 2,494,808 | 1/1950 | Haeberlin | 26/18.5 |
| 3,188,837 | 6/1965 | Von Ondarza et al. | 68/8 |
| 3,880,579 | 4/1975 | Renaut | 101/470 |
| 3,890,811 | 6/1975 | Fleissner | 101/119 |
| 3,915,628 | 10/1975 | Bossard et al. | 68/5 D |
| 3,949,574 | 4/1976 | Glover | 101/470 |

FOREIGN PATENT DOCUMENTS

| | | | |
|---|---|---|---|
| 232,082 | 9/1959 | Australia | 8/14 |
| 2,113,739 | 10/1972 | Germany | 101/471 |

OTHER PUBLICATIONS

Textile World, Feb. 1972, pp. 50 and 52, Transfer printing: (large labeled diagram of schematic included).

Textile Month, Jan. 1971, pp. 55, 57, 58; The Transfaprint.

*Primary Examiner*—Clyde I. Coughenour

*Attorney, Agent, or Firm*—Burgess, Dinklage & Sprung

[57] ABSTRACT

The invention provides a process for the continuous, dry transfer of organic compounds, in particular of finishing and improving agents, to webs of air-permeable organic materials, preferably to textile webs of polyester, polyamide, polyacyclonitrile and/or cellulose by passing the webs and organic compound carriers over a heating means and subsequently over a suction means with the heating being from the carrier side and suction from the web side.

16 Claims, 2 Drawing Figures

DRY TRANSFER OF ORGANIC COMPOUNDS TO WEBS

Figure 1:
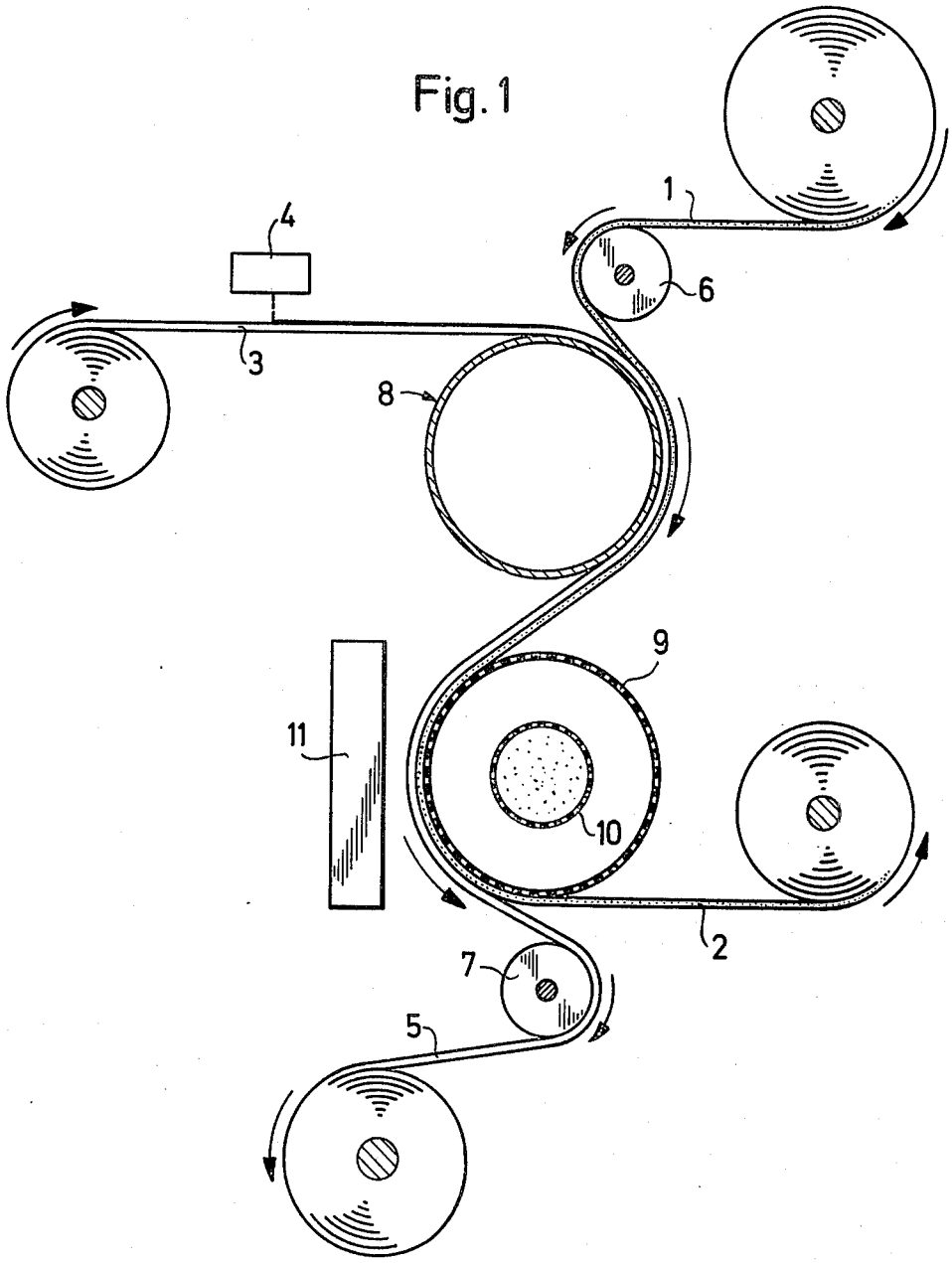
Figure 2:
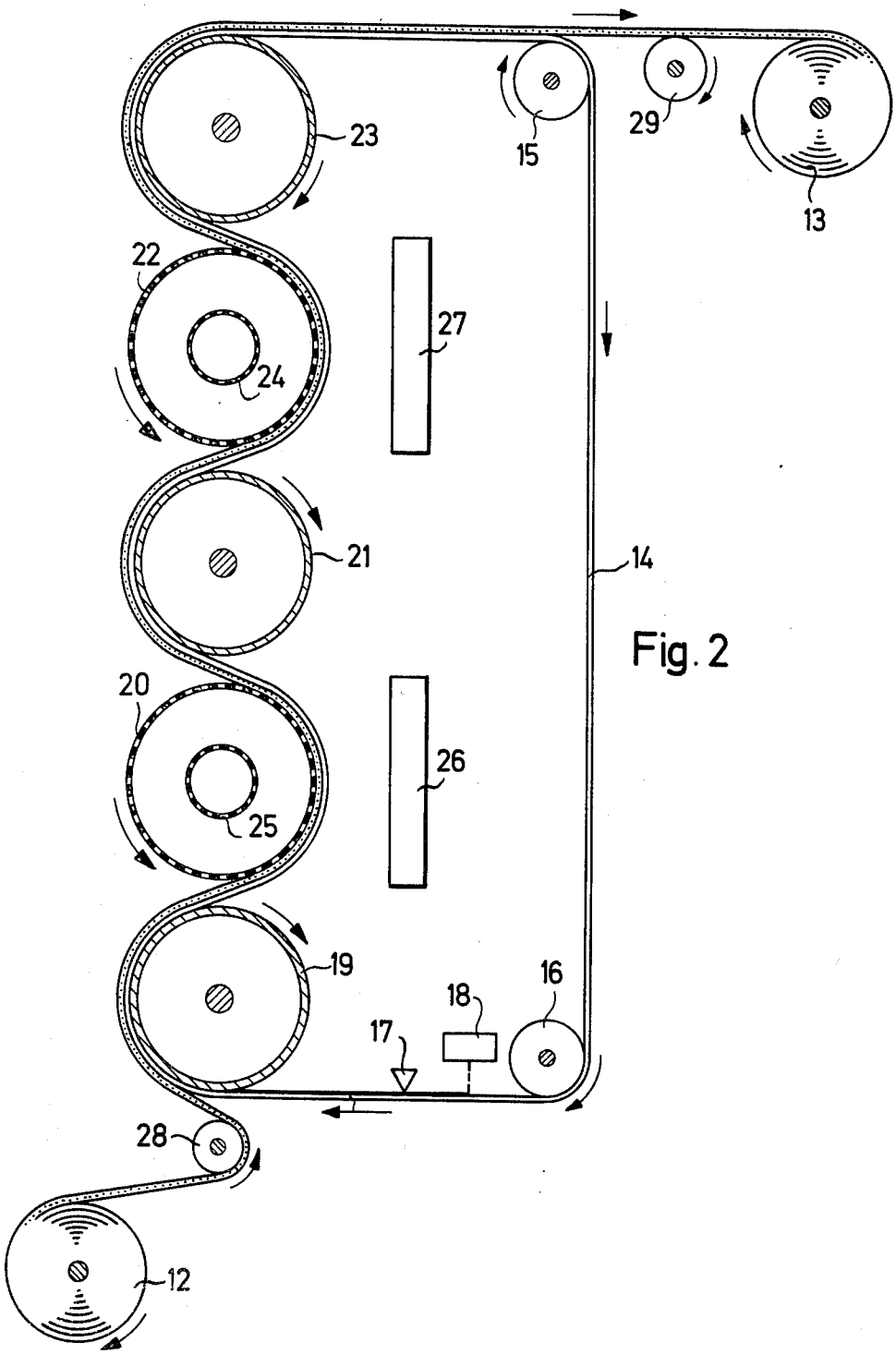

This is a continuation of application Ser. No. 497,599, filed on Aug. 15, 1974 now abandoned.

The process comprises the following steps:

1. Applying to a carrier such as polytetrafluoroethylene or polyester sheet or glass cloth preparations which contain one or several compounds e.g. textile finishing agents that are converted into the vapour state at atmospheric pressure and at a temperature above 80° C, preferably 100° to 220° C optionally a binder which is stable below 250° C and/or a solvent, and, optionally, drying said preparations, 2. bringing said carrier into contact with the side of the air-permeable web of organic material to be treated in such a manner that web and carrier advance together synchronously, the one superimposed on the other, 3. subjecting carrier and web alternately, optionally under mechanical pressure, to at least one heat treatment of at least 80° C applied from the carrier side and one suction treatment from the web side, optionally combined with a second heat treatment of at least 80° C applied from the carrier side, and continuing or repeating this treatment until the compound has been transferred to the web, which is fed in one or up to 10 layers, so that the same section of the web passes through the same heating/suction cycle one or up to 10 times, and 4. separating the treated web from the carrier. Advantageously, the web or alternately subjected to 2 to 20 heat and suction treatments, whereby the running speed of the web is up to 100 m/min. preferably 20 to 50 m/min. The invention also provides a suitable apparatus for carrying out the above process.

The invention provides a process for the continuous, dry transfer of organic compounds, in particular of textile finishing and improving agents, to webs of air-permeable organic materials, which comprises 1. applying to a carrier preparations which contain at least one compound that is converted into the vapour state at atmospheric pressure and at a temperature above 80° C, optionally a binder which is stable below 250° C and/or a solvent, and, optionally, drying said preparations, 2. bringing said carrier into contact with the side of the air-permeable web of organic material to be treated in such a manner that web and carrier advance together synchronously, the one superimposed on the other, 3. subjecting carrier and web alternately, optionally under mechanical pressure, to at least one heat treatment of at least 80° C applied from the carrier side and one suction treatment from the web side, optionally combined with a continuation or repetition of this treatment until the compound has been transferred to the web, which is fed in one or more layers, so that the same section of the web passes through the same heating/suction cycle one or more times, and 4. separating the treated web from the carrier.

The carrier required for the process according to the invention is preferably endless, but it can also be adapted to suit the webs of organic material to be treated, i.e. they can be cut into pieces. As a rule the carrier is inert, i.e. it possesses no affinity for the preparation that contains the compound to be transferred. The carrier can be air-permeable or, preferably, air-tight.

Desirably, the carrier is a flexible, preferably three-dimensionally stable ribbon or web or a foil which is stable to heat. Air-permeable carriers with continuous surface are e.g. perforated or porous.

The carriers can be made from a wide variety of materials, e.g. metal, plastic, glass, paper or textile fibres. Examples of suitable carriers are those of perforated or porous metal strips (steel, aluminium, copper), met fibre fleeces, perforated or porous plastic sheets, glass fibre fleeces of glass cloths, airtight or perforated or porous paper, nonwoven fabrics, woven or knitted textiles or felts.

Examples of materials which have proved particularly suitable are paper, aluminium, or steel strips which can be perforated or unperforated, glass cloths, plastic sheets which can be perforated or unperforated, in particular those of polyester or polytetrafluoroethylene, and nonwoven fabrics, e.g. webs of polyester or polyamide fibres.

Also suitable are carriers with plastic coatings in the form of perforated or unperforated films, e.g. coatings of polyvinyl resins, ethyl cellulose, polyurethanes or polytetrafluoroethylene.

In addition to the compounds which are transferred to the material web, the preparations used according to the invention can contain at least one binding agent which is stable below 250° C, water and/or an organic solvent.

Suitable binding agents are synthetic, semi-synthetic or natural resins, both polycondensation and polyaddition products being possible. In effect, it is possible to use all binding agents conventionally used in the paint and printing ink industry. The binding agents are used to fix the compounds to be transferred at the treated area of the carrier. But at the transfer temperature they should not melt, react with each other, i.e. crosslink, and should be capable of releasing the compound to be transferred. Preferred binding agents are those that dry rapidly in a warm current of air and form a fine, desirably non-tacky film on the carrier. Examples of suitable water-soluble binding agents are: alginates, tragacanth, carubin (from locust bean meal), dextrin, ehterified or esterified mucilages, carboxymethyl cellulose or polyacrylamide. Examples of binding agents that are soluble in organic solvents are: cellulose esters, e.g. nitrocellulose or cellulose acetate and, in particular, cellulose ethers, e.g. methyl cellulose, ethyl cellulose, propyl cellulose, isopropyl cellulose, benzyl cellulose or hydroxyethyl cellulose, and mixtures thereof.

Suitable organic solvents are those that are miscible or immiscible with water or solvent mixtures with a boiling point at normal pressure below 150° C, preferably below 120° C. It is advantageous to use aliphatic, cycloaliphatic or aromatic hydrocarbons, e.g. toluene, cyclohexane, petroleum ether; lower alkanols, e.g. methanol, ethanol, propanol, isopropanol, esters of aliphatic monocarboxylic acid, e.g. ethyl acetate or ethyl propylate; aliphatic ketones, e.g. methyl ethyl ketone and halogenated aliphatic hydrocarbons, e.g. perchloroethylene, trichloroethylene, 1,1,1-trichloroethane or 1,1,2-trichloro-2,2,1-trifluoroethylene. Particularly preferred solvents are loser aliphatic esters, ketones or alcohols, e.g. butyl acetate, acetone, methyl ethyl ketone, ethanol, isopropanol or butanol and mixtures thereof, e.g. a mixture of methyl ethyl ketone and ethanol in the ratio 1:1. The desired viscosity of the printing pastes can then be regulated by addition of the cited binding agent with a suitable solvent.

The weight ratio of the individual components to the preparation used for the preliminary treatment can vary widely and is e.g. for the compounds to be transferred to the fibrous material within 0.1 to 100%, for the binding agent within 0 to 30%, for the solvent or solvent mixture within 0 to 99%, based on the total weight of the preparation. The amount in which the compound to be transferred to the fibrous material can be applied to the carrier is 1 g to 100 g, preferably 15 g to 40 g per $m^2$.

The preparations used according to the invention can be manufactured e.g. by dissolving or finely dispersing in water and/or an organic solvent a compound which is transferred to the fibrous material at atmospheric pressure and at temperature above 80° C, advantageously in the presence of a binding agent which is stable below 250° C.

It is expedient to apply these preparations to the inert. moving carrier continuously, for example by spraying, coating or, preferably, by printing it over part of or over the entire surface. Principally when using paper carriers and those made of stainless steel, it is possible to use the most diverse printing methods, e.g. relief printing (e.g. book printing, flexoprinting), intaglio printing (e.g. roller printing), silk-screen printing (e.g. rotary screen printing, flat-screen printing) or electrostatic printing.

It is also possible to apply organic compounds by themselves direct, i.e. without the addition of binders and solvents, by spinkling, spraying, pouring, slop padding or with a doctor blade.

A particular embodiment of the present process consists in applying the organic compound in pattern form to a web of material, e.g. by printing it, or instead of a complete web, applying cut pieces of the carrier to the fibrous material to be treated. These patterns are obtained by punching or cutting suitable segments into the carriers cited hereinabove.

After the preparations have been applied to the carrier they may be dried, e.g. in a warm current of air or by infrared radiation, if appropriate with recovery of the solvent employed. But if the organic compounds to be transferred are applied direct by themselves, then such a drying is unnecessary.

Depending on the sublimation behaviour of the compounds to be transferred, the treated side of the carrier and, if this latter is air-permeable, the untreated or treated side of the carrier, is then brought into intimate contact with the surface of the web of material to be treated and carrier and web are together subjected to a heat treatment of at least 80° C and preferably 100° to 220° C, in particular 150° to 200° C. Particularly good results are obtained with temperatures of 180° to 220° C.

According to the invention, this heat treatment is combined with a vacuum treatment in that the carrier/-web sandwich which moves in the same direction and at the same speed is alternately heated and subjected to suction. While suction is being exerted, it is also possible to heat simultaneously. The vacuum is so regulated that as little of the substance to be transferred as possible is carried away by the current of air. This heating/suction cycle is repeated until the agents have been transferred from the carrier to the web of material.

A suitable apparatus for carrying out the process according to the invention consists of at least one heating cylinder and one suction cylinder, preferably of a series of altogether 2 to 20, in particular 4 to 16, heating and suction cylinders into which the web of material to be treated can be fed in one single layer or in several layers. If the web is fed in a single layer, it is therefore subjected to 2 to 20, preferably 4 to 16, heating and suction treatments. The series of heating and suction cylinders can advantageously be grouped in units of e.g. 6 cylinders each. Normally, one heating cylinder alternates in each case with one suction cylinder. But depending on the sublimation behaviour of the compounds to be transferred, the number of suction cylinders can also be reduced in proportion to the number of heating cylinders by e.g. connecting one or possibly two suction cylinders after every second, third or sixth heating cylinder. An arrangement in which only 1 to 2 suction cylinders are connected after a series of 2 to 18 or 19 heating cylinders has also proved suitable. Depending on the unit, the web of material to be treated can be fed in as a single layer or in several layers, e.g. singly in a first unit and in several layers in a second unit.

The heating cylinders can be heated electrically or with heated liquids, e.g. oil, or with gas, so that the surface temperature of the cylinder is desirably about 170° to 220° C. The vacuum action of the suction cylinder can be supported in addition by e.g. a heat radiator on the opposite side. Such suction cylinders are normally wrapped in felt.

The material input depends on the desired application form of the finishing agents. The application to the carrier can be effected on each side individually or on both sides; but if a carrier which is impermeable to air is used, only the single sided application is desirable. The application of the finishing agents can be carried out on the desired side or on both sides by appropriate conveyance of the carrier web. If as superficial a deposit as possible of the finishing agents is desired, only a single layer is fed in or if several layers are fed in, the material is first brought into contact with the carrier. The penetration of the entire material is improved if each freshly introduced layer of material is fed into the machine e.g. as 4th. or 5th. layer, in other words having no direct contact with the carrier. The penetration of the material with the finishing agents is then effected according to the countercurrent principle. This multiple passage of the material through the suction/heating cycle makes it possible to compensate for high treatment temperatures by longer treatment times.

Preferably, the process according to the invention is carried out with 1 to 10, in particular with 1 to 5, layers. If series of heating and suction cylinders are grouped in several units, the number of these layers can be varied in the different units.

The heat treatment which may be combined with the suction treatment can be effected in various ways, e.g. by means of a heating plate, a current of warm air, a heated backing roll or, in particular, by infrared radiation.

A further advantage of the process according to the invention is that it is possible to operate with very high speeds on account of the large amount of material fed in. For example, it is possible to carry out the process with running speeds of up to 100 m/min., e.g. 20 to 90 m/min. or, in particular, 20 to 50 m/min. At a transfer time of about 30 seconds and with 5 layers of material, for example, the speed is 90 m/min. In contradistinction thereto, running speeds of only 2 to 3 m/min, are attained using known transfer processes.

By appropriate choice of the carrier structure (e.g. woven fabric, nonwovens, grained paper) and of the material feed, i.e. lighter, or heavier contact pressure or no pressure at all on the carrier/web sandwich, it is possible to produce desired calender effects on the material to be treated.

Suitable air-permeable, organic material that may be treated according to the invention is principally organic but above all textile fibrous material. The fibrous material can be in the most diverse forms of processing, e.g. yarn, especially in piece form, for example woven or knitted fabrics or non-wovens. The material can be dyed in the conventional way, printed or finished before or after the treatment according to the invention.

The fibrous material itself can be of natural, regenerated man-made or, above all, synthetic man-made fibres. Examples of natural fibres are in particular those of wool or cellulose, e.g. cotton, linen, hemp or ramie, and examples of regenerated man-made fibres are those of viscose. Preferably, textile materials containing synthetic man-made fibres are used.

As examples of synthetic man-made fibrous material that can be treated according to the invention there may be mentioned: cellulose ester fibres, e.g. cellulose 2½-acetate and cellulose triacetate, synthetic polyamide fibres, e.g. those of poly-ε-caprolactam (nylon 6), polyhexamethylenediamine adipate (nylon 66), poly-ω-aninoundecanoic acid (nylon 7), polyurethane or polyolefin fibres, e.g. polypropylene fibres, acid modified polymides, e.g. polycondensation products of 4,4'-diamino-2,2'-diphenyl-disulphonic acid or 4,4'-diamino-2,2'-diphenylalkane-disulphonic acids with polyamide-forming starting materials, polycondensation products of monocarboxylic acids and their amide-forming derivatives or dibasic carboxylic acids and diamines with aromatic dicarboxy-sulphonic acids, e.g. polycondensation products of ε-caprolactam or hexamethylenediammonium adipate with potassium-3,5-dicarboxybenzenesulphonate, or acid modified polyester fibres, e.g. polycondensation products of aromatic polycarboxylic acids, e.g. terephthalic acid or isophthalic acid, polyhydric alcohols, e.g. ethylene glycol and 1,2- or 1,3-dihydroxy-3-(3-sodium sulphopropoxy)-butane, 2,2-bis-(3-sodium sulphopropoxyphenyl)-propane or 3,5-dicarboxybenzenesulphonic acid or sulphonated terephthalic acid, sulphonated 4-methoxybenzenecarboxylic acid or sulphonated diphenyl-4,4'-dicarboxylic acid.

Preferably, however, the fibrous material is of polyacrylonitrile or acrylonitrile copolymers, synthetic man-made polyamide fibres, preferably polyhexamethylenediamine adipate and, primarily, linear polyester fibres, especially of polyethylene glycol terephthalate or poly-(1,4-cyclohexane-dimethylol)-terephthalate.

If the material is of acrylonitrile copolymers, the acrylonitrile proportion is desirably at least 50% and preferably at least 85% by weight of the copolymer. Other vinyl compounds are normally used as comonomers, e.g. vinylidene chloride, vinylidene cyanide, vinyl chloride, methacrylate, methyl vinyl pyridine, N-vinylpyrrolidone, vinyl acetates, vinyl alcohol, acrylic amide or styrenesulphonic acids.

These materials can also be used as blends with one another or with other fibres, e.g. blends of polyacrylonitrile/polyester, polyamide/polyester, polyester/viscose and polyester/wool, polyester/cellulose, in particular polyester/cotton.

The preparations used according to the invention are applied to the carrier e.g. by spraying, coating, sprinkling or printing them over entire surface or over part of the surface.

When products in powder form are used, they are applied form a powder dispenser and products in paste form are applied with a doctor blade or an inclined plane. If the product is in dilute form, it can be applied by a slop pad roller or with a spray device.

The application of products in powder or paste form has the advantage that a binder need not be used simultaneously, for binders often lead to incrustations in the apparatus. The cleaning of the carrier, providing it is endless, can also be dispensed with. A special dissolving in a solvent and the specific problems in connection therewith (solvent vapours) also do not arise.

The invention also provides the apparatus for carrying out the dry transfer process described hereinbefore. This apparatus comprises a. a web-shaped carrier which advances in the longitudinal direction, b. a means for applying organic compounds to the carrier, and following said means in the direction of travel, c. a sequence of at least one heating unit and one suction unit and optionally additional heating units which are combined with the suction unit, and d. a means for conveying the web of organic material to the carrier and a means for transporting the treated web away from the carrier again, said apparatus being so constructed that carrier and web advance together synchronously, the one superimposed on the other, and are together transported to the heating and suction units, and, after the organic compound has been transferred from the carrier to the web at a temperature above 80° C, web and carrier are separated from each other, it being possible to feed the web into said apparatus in one or more layers simultaneously.

In FIG. I, 1 is the untreated and 2 is the treated web of material, 3 is the carrier to which the organic compound is to be applied, 4 is the means for applying organic compounds, 5 is the carrier after the organic compounds have been transferred to it, 6 is the means for conveying the web to the carrier, 7 is the means for transporting the treated web away from the carrier, 8 is the heating unit in the form of a heatable cylinder, 9 is the suction unit in the form of a suction cylinder, 10 is the suction means of the suction unit, and 11 is the additional heating unit, e.g. infrared heater, which may be combined with the suction device.

A preferred embodiment of the process according to the invention can be carried out in the apparatus illustrated in FIG. II. The textile material to be treated is on the roller 12 and is wound onto the roller 13 after the finishing agents have been transferred to it. The endless band 14, which is advanced or driven by rollers 15 and 16 is an air-permeable carrier, e.g. a metal fibre fleece, a polyamide fibre web or a glass cloth. The application of the textile finishing is improving agents 17 is effected using a dispenser or roller, 18 is a blade, 19, 21 and 23 are oil-heated rollers with a surface temperature of 190° C to 210° C. Each of the rollers 20 and 22 consists of a suction cylinder wrapped in felt, 24 and 25 are the suction means, 26 and 27 are infrared heaters. The application means 17 and 18 can also be on the other side of the carrier, which, however, requires corresponding guide means for the carrier in order that the application can still be effected from above, 28 is the means for conveying the web of material to the carrier and 29 is the means for transporting the treated web away from the carrier again.

Organic compounds which are converted into the vapour state at atmospheric pressure and above 80° C, especially at 100° to 220° C, are principally sublimable disperse dyes and, in particular, finishing agents. By finishing agents are meant e.g. fluorescent brighteners and, above all, textile improving agents, which include pretreatment, textile finishing, and textile protective agents.

The sublimable disperse dyes which can be used according to the invention can belong to the most diverse dyestuff classes. In particular they are monoazo, quinophthalone, methine and anthraquinone dyes, as well as nitro, styryl, azostyryl, naphthoprinone or naphthoquinone-imine dyes.

The commercial products of these dyes usually contain dispersants, i.e. a product with surface-active properties which makes it possible or makes it easier to disperse these dyes in water. Dispersants are not necessary if anhydrous preparations are used.

Examples of sublimable disperse dyes which can be used according to the invention are:

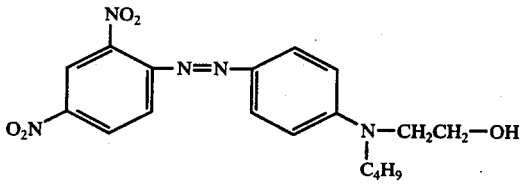

(1)

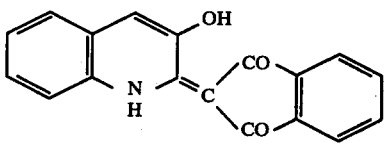

(2)

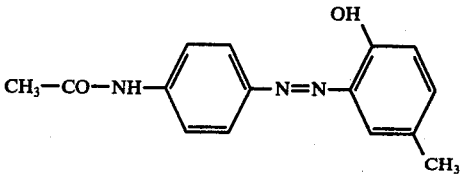

(3)

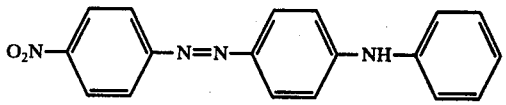

(4)

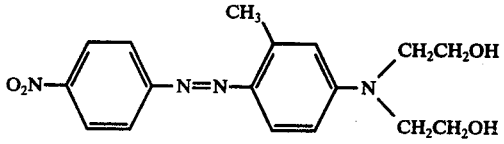

(5)

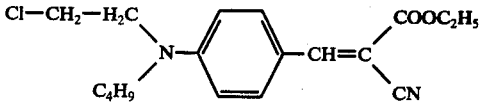

(6)

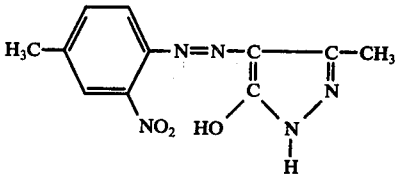

(7)

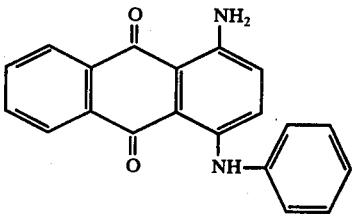

(8)

-continued
(9)
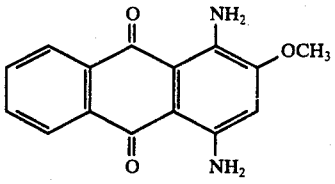
(10)
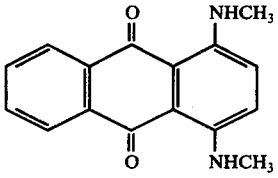
(11)
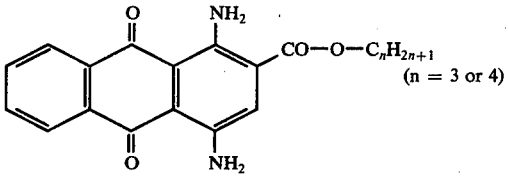
(12)
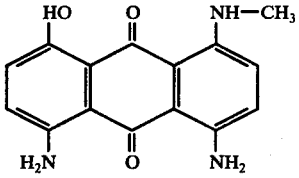
(13)
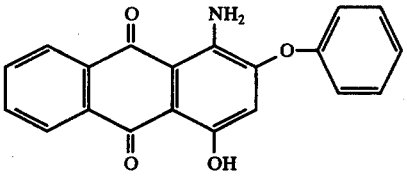
(14)
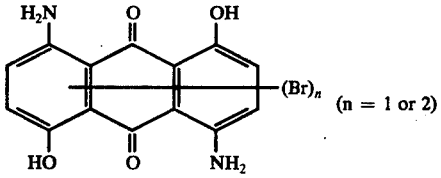
(15)
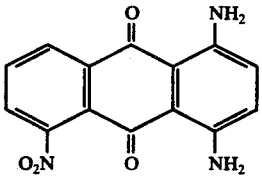
(16)
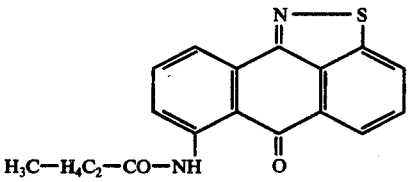
(17)
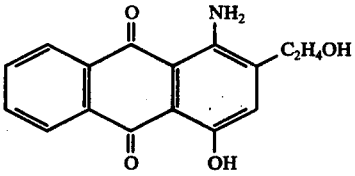

-continued
(18)
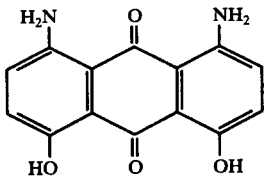
(19)
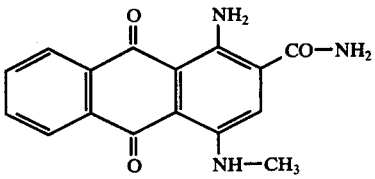
(20)
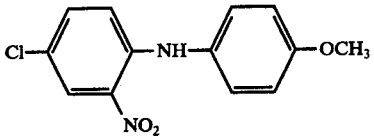
(21)
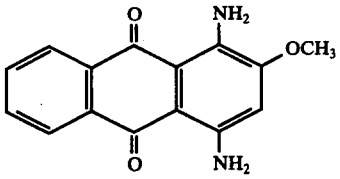
(22)
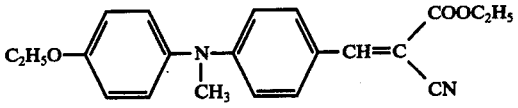
(23)
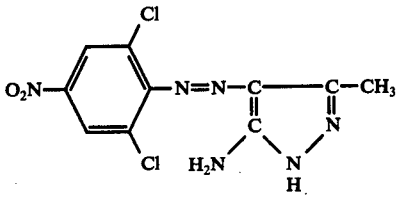
(24)
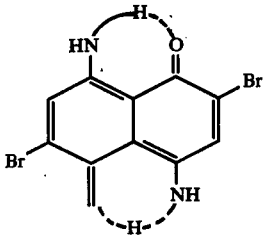
(25)
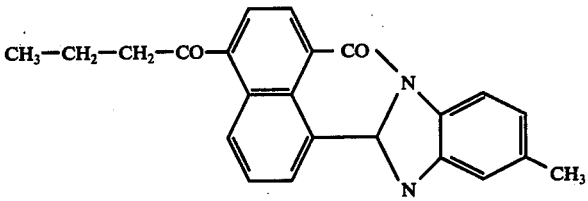
(26)
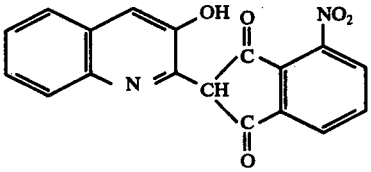

-continued (27)

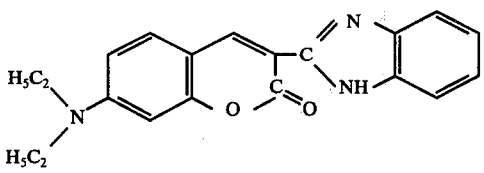

The preferred dirperse dyes are those of the formulae (2), (10) and (13).

The sublimable fluorescent brighteners can belong to any desired class of brightener. In particular they are cumarins, benzocumarins, pyrazones, pyrazolines, oxazines, oxazolyl, thiazolyl, dibenzoxazolyl or dibenzimidazolyl compoundss, and also naphthalic imides. Examples of sublimable fluorescent brighteners which can be used according to the invention are:

(28)

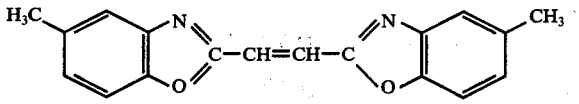

(29)

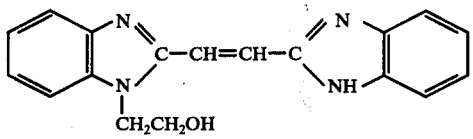

(30)

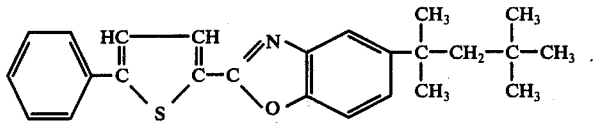

(31)

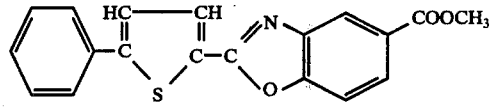

(32)

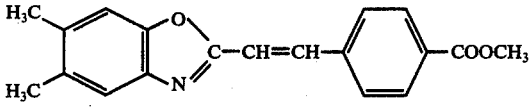

(33)

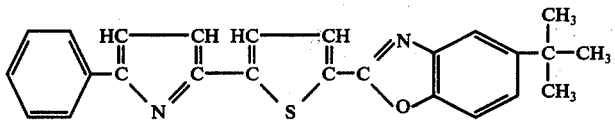

(34)

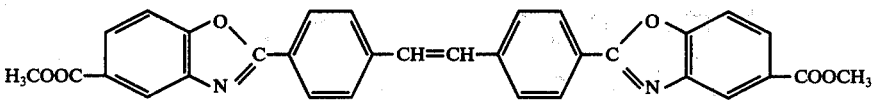

(35)

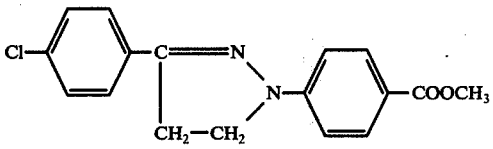

(36)

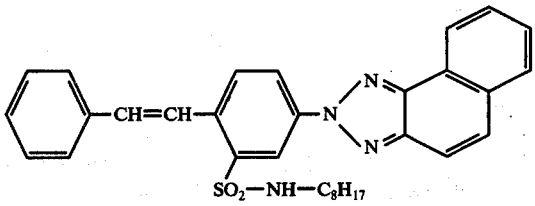

-continued (37)

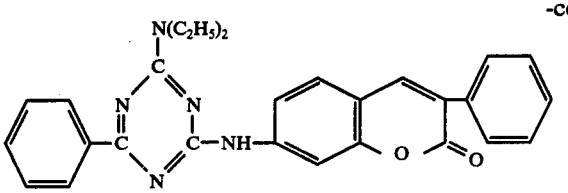

(38)

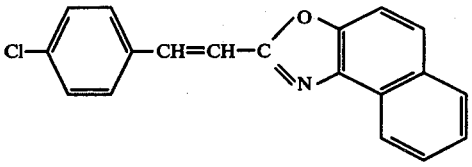

(39)

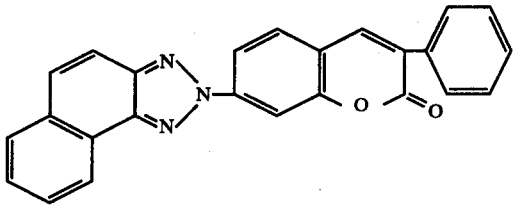

(40)

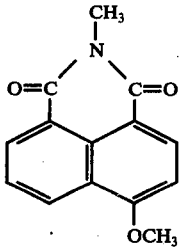

(41)

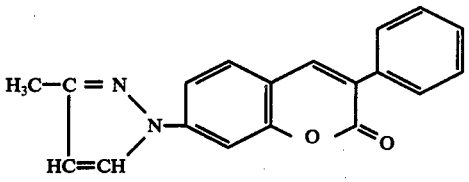

(42)

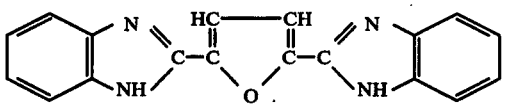

(43)

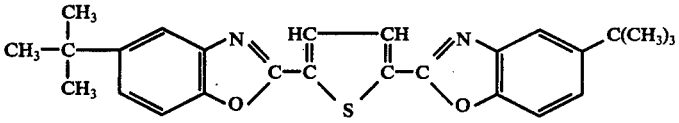

(44)

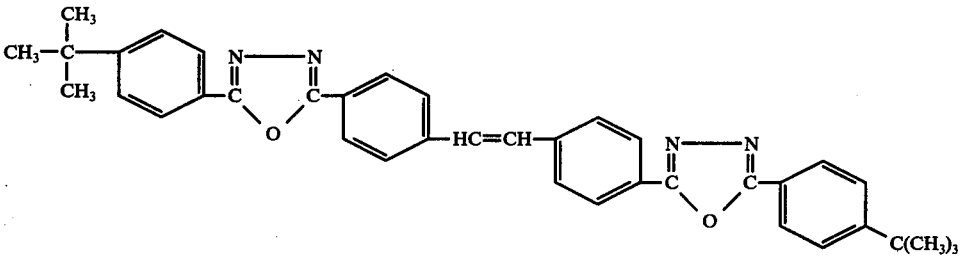

According to the invention however, preferably finishing agents are transferred. As finishing agents which are transferred to the organic material at atmospheric pressure and at a temperature above 80° C, preferably at 100° to 220° C, there may be cited principally textile finishing agents, textile protective agents, in particular biologically active protective substance that impart to the textile material e.g. bacteriostatic and/or fungistatic and/or fungicidal properties and actual textile finishing agents that impart to the textile material the desired effect, e.g. antistatic, water repellent, handle-improving or flame-resistant effects. The cited textile protective and/or finishing agents can, if desired, be applied to the material to be finished together with disperse dyes and/or fluorescent brighteners that are converted into the vapour state at atmospheric pressure and at temperatures between e.g. 150° and 220° C.

The finishing agents which can be used according to the invention are known or they can be manufactured by processes which are known per se. They belong to the most diverse classes of chemicals.

As an example of a bacteriostatic protective substance there may be mentioned the compound of the formula

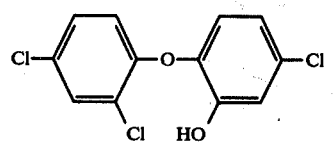

(45)

and as example of a fungistatic protective substance the compound of the formula

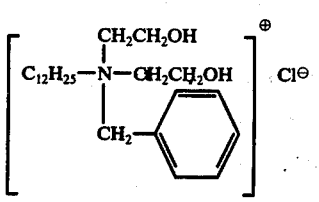

(46)

and of the formula

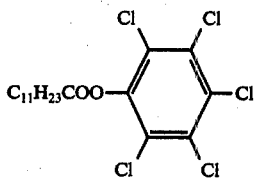

(47)

An example of a compound that imparts handle-improving properties to the textile fabric is that of the formula

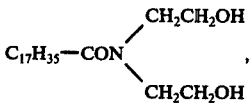

(48)

and examples of compounds that impart antistatic properties to the textile fabric are those of the formulae

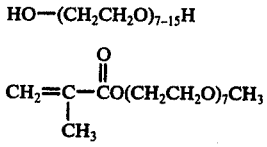

(49)

(50)

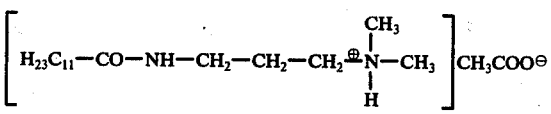

(51)

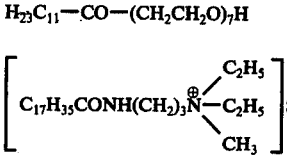

(52)

(53)

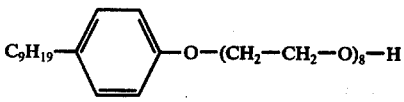

(54)

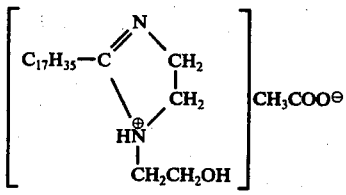

(55)

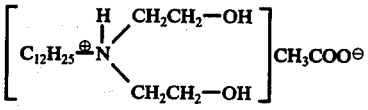

(56)

The preferred compounds are those of the formulae (54) and (56).

Examples of compounds that impart water repellent properties to the textile material are those of the formulae

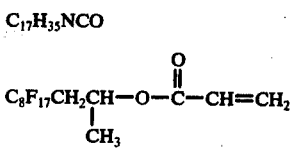

(57)

(58)

-continued (59)

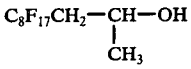

(60)

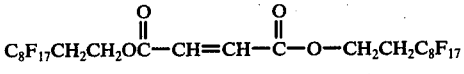

(61)

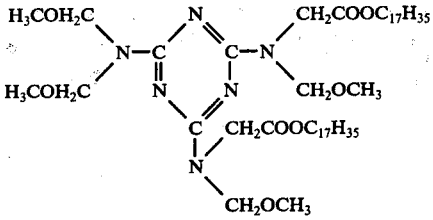

or methylhydrogen polysiloxanes or dimethyl methylhydrogen polysiloxanes.

The preferred compounds are the dimethyl methylhydrogen polysiloxanes.

The following compounds are examples of suitable flameproofing agents:

A) Methylenedioxybenzene compounds of the formulae (62)

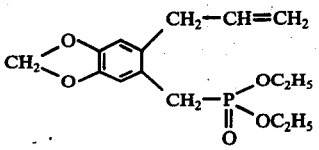

(63)

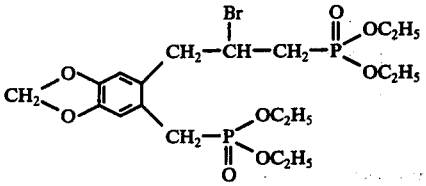

(64)

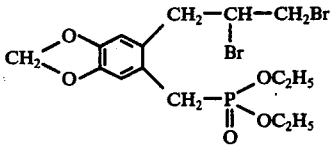

(65)

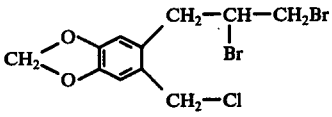

B) Phosphorus compounds of the formulae (66)

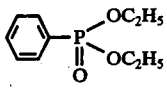

(67)

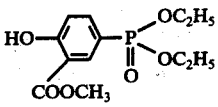

(68)

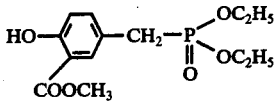

-continued (69)

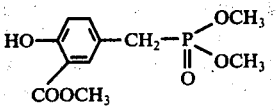

(70)

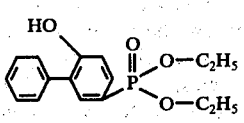

(71)

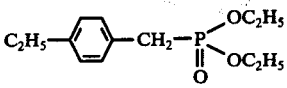

(72)

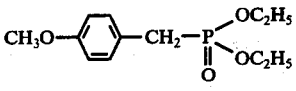

(73)

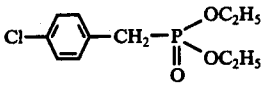

C) Phosphorus compounds of the formulae (74)

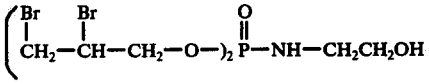

(75)

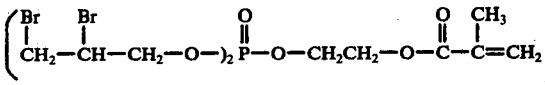

(76)

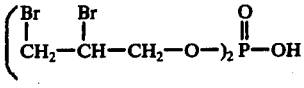

(77)

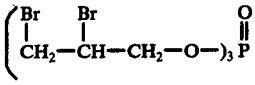

The preferred compounds are those of the formulae (75) and (77).

(78)

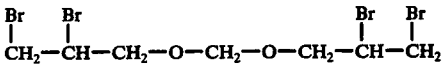

(79)

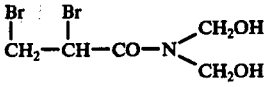

(80)

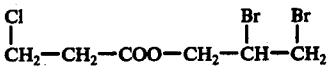

(81)

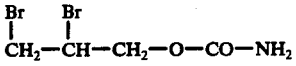

(82)

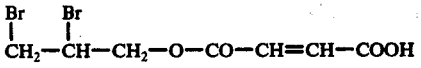

(83)

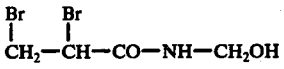

(84)

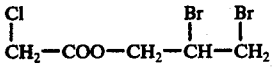

(85)

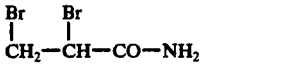

The preferred compounds are those of the formulae (83) and (84).

(86)

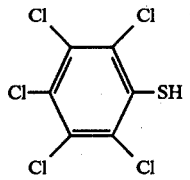

(87)

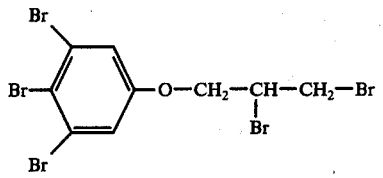

(88)

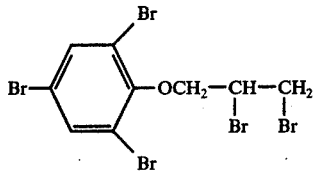

(89)

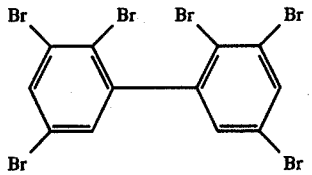

(90)

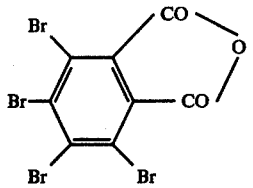

(91)

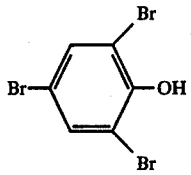

(92)

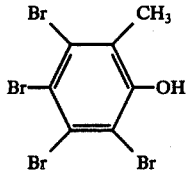

When choosing the organic compound or compounds and especially of the textile finishing agent or agents, allowance is made on the one hand for the desired effects and on the other for the temperature at which these compounds are transferred to the organic material without decomposition. Preferred compounds are those having transfer temperatures between 100° C and 220° C, in particular between 150° C and 200° C. To attain several finishing effects in one procedure, it is preferable to use textile finishing agents with as similar transfer properties as possible, i.e. those with similar transfer temperatures that do not differ by more than 20° C.

In the following Examples which illustrate the invention, the percentages are by weight.

EXAMPLE 1

Dimethyl methylhydrogen polysiloxane (viscosity 20–40 cst at 25° C) is applied with a slop pad roller to an endless carrier of glass cloth (7 g/m²).

The side to be treated of the carrier advancing at a speed of 20 m/min. is brought into contact with the web of polyester/cotton (50:50) poplin (140 g/m²), which has previously been sprayed with 0.2% of $ZrOCl_2$ (catalyst) and which advances at the same speed as the carrier, in such a manner that carrier and web of material are together transported synchronously with the one superimposed the other. Carrier and web of material are then fed into an apparatus as described in FIG. II. The 1st., 2nd, and 5th. cylinders (cf. 19, 21 and 23 in FIG. II) are heating cylinders of 90 cm diameter and with a temperature of 190° C. The 2nd. and 4th. cylinder (cf. 20 and 22 in FIG. II) are suction cylinders of the same diameter.

After the first passage, the web of material is fed a second time into the apparatus, so that there are always 2 layers of web in the apparatus (an inner one directly on the carrier, the outer one in connexion with the inner one but separated from the carrier).

After the entire web of material has run twice through the apparatus on each occasion, web and carrier are separated from each other. A cleaning of the carrier is unnecessary since only pure substance is applied.

The finished polyester/cotton poplin has values of 80 to 100 in the AATCC Spray Test 12-1966, whereas a comparison sample which was not finished has values from 0 to 20. This test for evaluating the water repellent properties of textiles specifies values in the range from 0 (minimum) to 100 (maximum).

Similar results are obtained with the compounds of the formulae (57), (58), (60) and (61), but without spraying the fabric with a catalyst, e.g. zirconium oxychloride, before treating it.

EXAMPLE 2

40 g of one of the yellow, blue or red dyes of the formulae (2), (10) or (13) and 100 g of ethyl cellulose in 860 g of a methyl ethyl ketone/ethanol mixture (weight ratio 1:1) are ground for 5 hours at 20° C in a sand mill and dispersed to form a homogeneous printing ink.

Paper carriers are then printed with one of these inks so as to give a dye application of 0.5 to 4 g/m² after the solvent has been evaporated at 20° C. One of these printed paper carriers together with a polyester fabric (120 g/m²) is fed in a single layer into an apparatus similar to that illustrated in FIG. II. The paper carrier is adapted to the length of the web of material to be dyed. The apparatus comprises 2 units the first of which, in the direction of travel of the carrier, consists of 6 rollers and the second unit of 4 rollers. The 1st, 3rd. and 5th. roller of the first unit and the 1st and 3rd. roller of the second unit are heating cylinders of 50 cm diameter which are heated to 215° C. The 2nd., 4th. and 6th. rollers of the first unit and the 2nd. and 4th. roller of the second unit are suction cylinders wrapped in felt of 50 cm diameter on which the paper carrier is heated from the reverse side to 220° C with an infrared heater during the suction cycle. Carrier and web of material pars once at the same speed through the apparatus at a speed of 60 m/min. and are subsequently separated.

A polyester fabric which is dyed a deep, level yellow (or blue or red) is obtained in this way.

EXAMPLE 3

The compounds of the formula (56) are slop padded as 50% solution in ethanol to give an application of 5 g/m² on an endless carrier consisting of a polytetrafluoroethylene web. This carrier is a component of an apparatus similar to that of FIG. II, except that it consists of only 4 rollers of which the 1st. and 3rd., in the direction of travel of the carrier, are heating cylinders with a diameter of 50 cm and are heated to 140° C, whereas the 2nd. and 4th. roller are suction cylinders of 50 cm diameter which cannot be heated.

A polyacrylonitrile fabric (130 g/m²) is then fed into the apparatus. After the fabric has passed once through the 4 rollers it is fed 4 more times into the apparatus and on each occasion the freshly introduced web is removed from the carrier, i.e. it passes into the apparatus as 2nd. and 3rd., 4th and 5th. layer. The fabric is subsequently separated from the carrier so that 5 layers of fabric having a total length of about 12 meters are always in the apparatus. The 5 layers of fabric move synchronously with the carrier at a speed of 90 m/min. Carrier and fabric are subsequently separated.

The electrostatic properties are tested by measuring the surface resistance in Ω/100cm² and the half life period indicates the time which passes until the voltage of a fabric electrostatically charged with 100 volts falls to 50 volts. The surface resistance of the polyacrylonitrile fabric is $10^{16}$Ω/100cm² before the treatment and $10^{11}$Ω/100 cm² after the treatment, which corresponds to a 10000-fold reduction of the surface resistance.

Before treatment the fabric has a half life period of 300 seconds, whereas after treatment this falls to only 5 seconds.

Similar results are obtained with the compounds of the formulae (51), (53) and (55).

EXAMPLE 4

The compound of the formula (54) is slop padded as oily, viscous liquid on an endless, airtight polyester carrier so as to give an application of 1.2 g/m². Since the carrier is airtight, it is necessary for the application means 17 and 18 of FIG. II to be so positioned that the activated side of the endless carrier can be brought into contact with the web of material to be treated. In divergence from FIG. II, the apparatus consists of 2 units each comprising 6 rollers of 50 cm diameter. The 1st., 2nd., 4th. and 5th. rollers of each unit, in the direction of travel of the carrier, are in the form of heating cylinders which are heated to 180° C and the 3rd. and 6th. rollers of each unit are suction cylinders which are each heated with infrared heaters to 200° C.

A polyester fabric (150 g/m²) is then fed into the apparatus. The fabric runs once through the apparatus synchronously with the carrier at a speed of 60 m/min. and is subsequently separated from the carrier. The treated polyester fabric is tested for its electrostatic properties as indicated in Example 3. As reported in Example 3, the treatment reduces the surface resistance by 10,000-fold. Before the treatment the polyester fabric has a half life period of 290 seconds and after the treatment this falls to only 1 second. Similar results are obtained with the compounds of the formulae (49) and (50).

EXAMPLE 5

A polyamide fabric (100 g/m²) is fed into an apparatus similar to that illustrated by FIG. II, except that it consists of 3 units. Each of the first two units through which the fabric passes comprises 6 rollers of 50 cm diameter. The first 5 rollers, in the direction of travel, are in the form of heating cylinders which are heated to 190° C. The 6th. and last rollers of each of the two units are suction cylinders which cannot be heated. The third unit through which the fabric passes after the first two consists of 4 rollers of 50 cm diameter, the first three of which, in the direction of travel, are heating cylinders which are heated to 195° C and the last is a suction cylinder which cannot be heated. An endless polyester sheet which is impermeable to air is used as carrier in the first two units and an air-permeable polytetrafluoroethylene web is used as carrier in the third unit.

Dibutyl tin dilaurate (catalyst) is slop padded as 10% solution in ethanol onto the carrier of the first two units to give an application of 1 g/m². Since the carrier is impermeable to air, it is necessary for the applications means to be positioned as in Example 4.

A dimethyl methylhydrogen polysiloxane with a molecular weight of 1350 to 1400 and a hydrogen silane content (measured by splitting off of hydrogen directly bonded to silicon) of 314 ml/g is slop padded onto the carrier of the third unit so as to give an application of 10 g/m².

The polyamide fabric is then fed into the apparatus in such a manner that it passes only once through the first two units but 4 times through the third unit. The fabric which is freshly run into the third unit has no direct contact with the carrier and passes into the third unit consequently as 2 nd., 3rd. and 4th. layer, so that there is always one layer of fabric in the first two units and 4 layers of fabric in the third unit, these layers having a total contact length of about 23 meters. The carrier and single layer of fabric in the first two units and the carrier and the 4 layers of fabric in the third unit all advance synchronously at a speed of 25 m/min. After it has passed through the third unit, the fabric is separated from the carrier. The polyamide fabric is tested for its water repellent properties in the following spray test:

Woven samples of fabric, 25 cm in length, are wetted with 500 ml of water. Any drops adhering to the fabric are removed and the moist samples weighed. The weight increase as index of the water repellent effect is reported in % of the dry fabric. The weight increase of an untreated polyamide comparison sample is 80 to 90%, but of a treated polyamide fabric it is only 10%.

EXAMPLE 6

One of the compounds (75) or (77) is slop padded as oily, viscous liquid onto an endless carrier consisting of a polytetrafluoroethylene web and forming part of the apparatus described in Example 3, so as to give an application of 25 g/m².

A polyester fabric (150 g/m²) is then fed in 5 layers into the apparatus as described in Example 3. The speed at which the carrier and fabric advance synchronously is 80 m/min. on using compound of the formula (75) and 60 m/min. on using the compound of the formula (77).

After the fabric has been separated from the carrier, the former is tested for its flame resistance, in comparison with untreated fabric, by the DOC 3-71 test. The test is also repeated after several household washes at 40° C in a liquor containing 4 g/l of a commercial light duty detergent. The results are summarised in Table I.

Table I

| Polyester fabric | after treatment | | before treatment | | after 1 wash | | after 2 washes | | after 10 washes | | after 20 washes | |
|---|---|---|---|---|---|---|---|---|---|---|---|---|
| | TL | CT | TL | CT | TL | CT | TL | CT | TL | CT | TL | CT |
| treated with the compound of the formula (75) | | | 6 | 10 | 4 | 2 | 4.5 | 6 | 6 | 13 | 5 | 1 |
| treated with the compound of the formula (77) | | | 7 | 2 | 3.5 | 1 | 6 | 4 | 6 | 4 | 4 | 1 |
| untreated | 12 | 22 | | | 4 | 9 | 10 | 25 | 4 | 19 | * | 28 |

* burns
TL = tear length in cm
CT = combustion time in seconds

Similar results are obtained with the compounds of the formulae (62) to (74) and (76).

The above flameproofing test, DOC FF 3-71 ("Children's Sleepwear Test"), is carried out as follows:

5 pieces of fabric, each measuring 8.9 cm × 25.4 cm, are clamped into a testing frame and dried with circulating air for 30 minutes at 105° C in a drying cabinet. The pieces of fabric are then conditioned in a sealed container over silica gel for 30 minutes and subsequently subjected to the actual flameproofing test in a combination chamber. The pieces of fabric are each ignited with a methane gas flame for 3 seconds in the vertical position.

The test is considered as having been passed if the acerage charred zone is not more than 17.5 cm in length and no single sample exhibits a carred zone of over 25.4 cm in length and the individual smouldering times are not longer than 10 seconds.

EXAMPLE 7

The procedure as described in Example 6 is carried out except that the compounds of the formulae (83) or (84) are applied with a doctor blade to the carrier so as to give an application of 36 g/m².

A polyamide fabric (130 g/m²) is fed into the apparatus in 5 layers as described in Example 3. The speed at which carrier and fabric advance synchronously is 60 m/min.

After the fabric has been separated from the carrier, the former is tested for its flame resistance, in comparison with untreated fabric, by the DOC 3-71 test (cf. Example 6). The results are summarised in Table II Table II

| polyamide fabric | combustion time in sec. | tear length in cm |
|---|---|---|
| treated with the compound of the formula (83) | 4 | 5.5 |
| treated with the compound of the formula (84) | 4.5 | 5 |
| untreated | 30 | burns away completely |

Similar results are obtained with the compounds of the formulae (78) to (82) and (85).

I claim:

1. A process for the continuous, dry transfer of an organic compound to a web of air-permeable organic textile material, comprising, the steps of 1. applying to a carrier a preparation which contains at least one organic compound that is converted into the vapour state at atmospheric pressure and at a temperature above 80° C,
2. bringing said carrier into contact with a side of the air-permeable web of organic textile material to be treated, in such a manner that web and carrier advance together synchronously, the one superimposed on the other,
3. subjecting carrier and web under atmospheric pressure to a heat treatment in a heating zone of at least 80° C sufficient to raise the temperature of the web to the temperature at which the organic compound is converted to the vapour state, said heat treatment being applied from the carrier side,
4. advancing said carrier and web from the heating zone and subsequently into a suction zone and subjecting said carrier and web to a suction treatment applied from the web side until the organic compound has been transferred from the carrier to the textile web, and
5. separating the treated web from the carrier.

2. The process according to claim 1, wherein the carrier is an air-permeable endless belt.

3. The process according to claim 1 wherein the carrier is a glass cloth, a steel fibre fleece, a perforated or a porous metal strip, a perforated or a porous plastic sheet, or an organic fibre web.

4. The process according to claim 1, wherein the organic compound has a transfer temperature in the range of 100° to 220° C.

5. The process according to claim 1, wherein the organic compound is a textile finishing agent.

6. The process according to claim 1, wherein the textile material contains polyester, polyamide, polyacrylonitrile and/or cellulose.

7. The process according to claim 1, wherein the running speed of the textile web is 20 to 100 m/min.

8. The process according to claim 1, wherein one to ten layers of the textile web is brought into contact with the carrier in step (2) and subjected to the heat and suction treatments of steps (3) and (4).

9. The process according to claim 1, wherein the textile web is alternatively subjected to 2 to 20 heat and suction treatments in steps (3) and (4) before the treated textile web is separated from the carrier.

10. The process of claim 1, wherein the preparation applied to the carrier in step (1) further contains a binder material.

11. The process of claim 1, wherein the preparation applied to the carrier in step (1) further contains a solvent.

12. The process of claim 11, wherein the preparation applied to the carrier in step (1), is dried prior to step (2).

13. The process of claim 1, wherein the carrier and textile web are subjected to mechanical pressure during the heat and suction treatments of step (3).

14. The process of claim 1, wherein the organic compound is selected from the group consisting of disperse dye-stuffs, antistatic agents, water repellents, handle improving agents, and flame resistant agents.

15. An apparatus for carrying out a continuous, dry transfer of an organic compound to a web of air-permeable organic textile material, which comprises a. a web-shaped carrier which advances in the longitudinal direction,
b. a means for applying an organic compound to the carrier, and moving said organic compound applied to said means in the direction of carrier travel, c. a sequence of a heating unit and a suction unit and d. a means for conveying a web of organic textile material to the carrier and a means for transporting the treated textile web away from the carrier again, said apparatus being so constructed that carrier and textile web advance together synchronously, the one superimposed on the other, and are together transported first the the heating unit the carrier next to the heating unit and subsequently to the suction unit with the web next to the suction unit where the organic compound is transferred from the carrier to the textile web at a temperature above 80° C, before web and carrier are separated from each other.

16. An apparatus according to claim 15, wherein the web-shaped carrier consists of an air-permeable endless carrier.

* * * * *

UNITED STATES PATENT AND TRADEMARK OFFICE

CERTIFICATE OF CORRECTION

PATENT NO. : 4,056,352

DATED : November 1, 1977

INVENTOR(S) : Fritz Mayer

It is certified that error appears in the above-identified patent and that said Letters Patent are hereby corrected as shown below:

Column 3, line 4, "99%" should be --99.9%--.

Column 5, line 24, "aninoundecanoic" should be --aminoundecanoic--.

Column 13, line 10, "dirperse" should be --disperse--

Column 13, line 33, "HC CH " should be --HC CH--

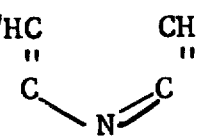

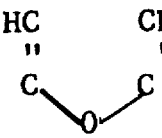

Column 25, line 26 to 27, "combination" should be --combustion--

Column 27, line 8, insert --with--after "unit".

Title Page - After "Assignee:" should read --Ciba-Geigy AG Basle, Switzerland--.

UNITED STATES PATENT AND TRADEMARK OFFICE

CERTIFICATE OF CORRECTION

PATENT NO. : 4,056,352

DATED : November 1, 1977

INVENTOR(S) : Fritz Mayer

It is certified that error appears in the above-identified patent and that said Letters Patent are hereby corrected as shown below:

Column 25, line 31, "acerage" should be

--average--.

Signed and Sealed this

Fourth Day of April 1978

[SEAL]

Attest:

RUTH C. MASON
Attesting Officer

LUTRELLE F. PARKER
Acting Commissioner of Patents and Trademarks